US006641516B2

(12) United States Patent
Ozeki

(10) Patent No.: US 6,641,516 B2
(45) Date of Patent: Nov. 4, 2003

(54) BIAS TAPE MAKER

(75) Inventor: Katsuhiko Ozeki, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 44 days.

(21) Appl. No.: 09/891,276

(22) Filed: Jun. 27, 2001

(65) Prior Publication Data

US 2002/0152725 A1 Oct. 24, 2002

(30) Foreign Application Priority Data

Apr. 20, 2001 (JP) ..... 2001-122083

(51) Int. Cl.[7] ..... B31F 1/00

(52) U.S. Cl. ..... 493/438; 493/439; 493/455; 223/37

(58) Field of Search ..... 493/382, 347, 493/438, 439, 455, 440; 223/37

(56) References Cited

U.S. PATENT DOCUMENTS 351,452 A * 10/1886 Marsh et al. ..... 493/439
1,723,543 A * 8/1929 De Santis ..... 223/37
1,771,328 A * 7/1930 Gabel ..... 223/37
2,956,799 A * 10/1960 Wasson ..... 493/439

* cited by examiner

*Primary Examiner*—Ted Kavanaugh
(74) *Attorney, Agent, or Firm*—Shaw Pittman LLP; Michael D. Bednarek

(57) ABSTRACT

A bias tape maker includes an outer shell including a tape entering port and a tape exiting port for introduction and exit of a main tape, respectively, and an inner core fitted in the outer shell for defining a main tape passage between the outer shell and the inner core. The main tape passage has a tape folding portion for folding longitudinal margins of the main tape toward each other. The outer shell is provided with an auxiliary tape entry window adjacent the tape exiting port for introducing an auxiliary tape into the tape folding portion of the main tape passage.

15 Claims, 8 Drawing Sheets

BIAS TAPE MAKER

BACKGROUND OF THE INVENTION

1. Field of the Invention

The present invention relates to a device for making a bias tape which is mainly used for finishing or decorating clothing or the like. Such a device is referred to as a bias tape maker.

2. Description of the Related Art

A bias tape is a narrow strip of cloth having a pair of longitudinal margins folded toward each other. Such a bias tape may be made by cutting a cloth diagonally across the weave to provide an elongate bias cloth, and then folding the longitudinal margins of the bias cloth toward each other. The bias tape thus provided has a good stretch and a high flexibility so that it is suited for use in finishing or decorating clothes or the like.

FIG. 10 illustrates atypical prior art bias tape maker. The bias tape maker 100 comprises an outer shell 102 and an inner core 103 for insertion into the outer shell 102. The outer shell 102, which may be made by bending a thin metal plate, has a generally tubular configuration which is progressively flattened toward its front end. The outer shell 102 includes a pair of roof margins 21.

The inner core 103, which may be made of a resin, tapers from its rear end toward its front end. The inner core 103 is formed with a generally triangular platform 131 which is laterally formed with a pair of longitudinal engaging grooves 32.

As shown in FIG. 11, by engaging the roof margins 21 of the outer shell 102 with the engaging grooves 3, the outer shell 102 is assembled with the inner core 103. In the bias tape maker 100 thus assembled, a tape folding portion (not specifically shown) is defined between the inner core 102 and the outer shell 103.

In use, a bias cloth 11 is introduced into the bias tape maker 100 from the rear end thereof. In advancing through the non-illustrated tape folding portion toward the front end of the tape maker 100, the bias cloth 11 is continuously formed into a bias tape 1 provided with a pair of longitudinally extending folds 11*a*. The bias tape 1 thus formed is pulled out from the front end of the bias tape maker 100. The folds 11*a* may then be fixed or set by ironing for example.

The bias tape thus provided may be fixed on clothing for example in the following manner. First, the bias tape is bent into a desired configuration and ironed for example for setting the configuration. Then, the bias tape is disposed on clothing and provisionally fixed thereon with pins or needles for example. Then, the bias tape is sewed onto the clothing. Thus, the fixing process is rather complicated and troublesome.

For easier fixation, a bias tape is known which is provided with an auxiliary adhesive tape. Such a bias tape is hereinafter referred to as adhesive bias tape an example of which is shown in FIG. 9. As shown in the figure, the adhesive bias tape 1 comprises a bias cloth 11 (hereafter referred to as "main tape") including a pair of folds 11*a*, and an auxiliary tape 12 attached on the main tape 11. The auxiliary tape 12, which is in the form of a narrow strip, comprises an adhesive layer 12*a* which becomes tacky or sticky by heating, and a releasable substrate 12*b*, such as a silicone sheet, for releasably carrying the adhesive layer 12*a*.

For fixing the adhesive bias tape 1 onto clothing for example, the user removes the releasable substrate 12*b* from the adhesive layer 12*a*. Then, while bending the bias tape 1 into a desired configuration, the user provisionally fixes the bias tape 1 onto the clothing by ironing, and then sews it onto the clothing. Thus, the adhesive bias tape 1 can be fixed more easily than an ordinary (non-adhesive) bias tape.

Such an adhesive bias tape 1 may be formed by disposing an auxiliary tape 12 on the folds 11*a* of a main tape 11 and then bonding the auxiliary tape 12 to the bias tape 1 by thermally melting the adhesive layer 41 by ironing for example.

However, such fabrication of an adhesive bias tape has the following problems. Firstly, since both the auxiliary tape 12 and the main tape 11 are in the form of a narrow strip, it is difficult to accurately position the auxiliary tape relative to the main tape. Secondly, the ironing need be performed twice, i.e., for setting the folds 11*a* of the main tape 11 and for bonding the auxiliary tape 12 to the main tape 11, which is troublesome.

SUMMARY OF THE INVENTION

It is therefore an object of the present invention to provide a bias tape maker which facilitates the formation of an adhesive bias tape.

According to a first aspect of the present invention, a bias tape maker comprises an outer shell including a tape entering port and a tape exiting port for introduction and exit of a main tape, respectively, and an inner core fitted in the outer shell for defining a main tape passage between the outer shell and the inner core. The main tape passage includes a tape folding portion for folding longitudinal margins of the main tape toward each other. The outer shell is provided with an auxiliary tape entry window adjacent the tape exiting port for introducing an auxiliary tape into the tape folding portion of the main tape passage.

Preferably, the auxiliary tape entry window has a width equal to or slightly larger than that of the auxiliary tape.

In a preferred embodiment, the outer shell comprises a pair of roof margins which extend toward each other into abutment adjacent the tape exiting port, and the auxiliary tape entry window is defined by a cutout formed in the pair of roof margins adjacent the tape exiting port.

Preferably, the auxiliary tape guide groove may be aligned with the auxiliary tape entry window longitudinally of the auxiliary tape.

Preferably, the auxiliary tape guide groove has a width generally equal to that of the auxiliary tape.

Preferably, the upper portion of the inner core has a front end partially extending into the auxiliary tape entry window.

Preferably, the upper portion of the inner core has a rear end formed with a handle which in turn is formed with an auxiliary tape guide hole for introducing the auxiliary tape toward the auxiliary tape guide groove.

Preferably, the auxiliary tape guide hole may be aligned with the auxiliary tape guide groove and the auxiliary tape entry window longitudinally of the auxiliary tape.

Preferably, the handle is inclined backwardly upward, the auxiliary tape guide hole being provided at a base end of the handle.

According to a second aspect of the present invention, a bias tape maker comprises an outer shell including a tape entering port and a tape exiting port for introduction and exit of a main tape, respectively, and an inner core fitted in the outer shell for defining a main tape passage between the outer shell and the inner core. The main tape passage includes a tape folding portion for folding longitudinal margins of the main tape toward each other. The inner core includes an upper portion formed with an auxiliary tape guide groove for guiding an auxiliary tape toward the tape exiting port.

Other features and advantages of the present invention will become clearer from the detailed description given below with reference to the accompanying drawings.

DETAILED DESCRIPTION OF THE PREFERRED EMBODIMENTS

A preferred embodiment of the present invention will be described below in detail with reference to FIGS. 1 through 8 of the accompanying drawings.

Figure 1:
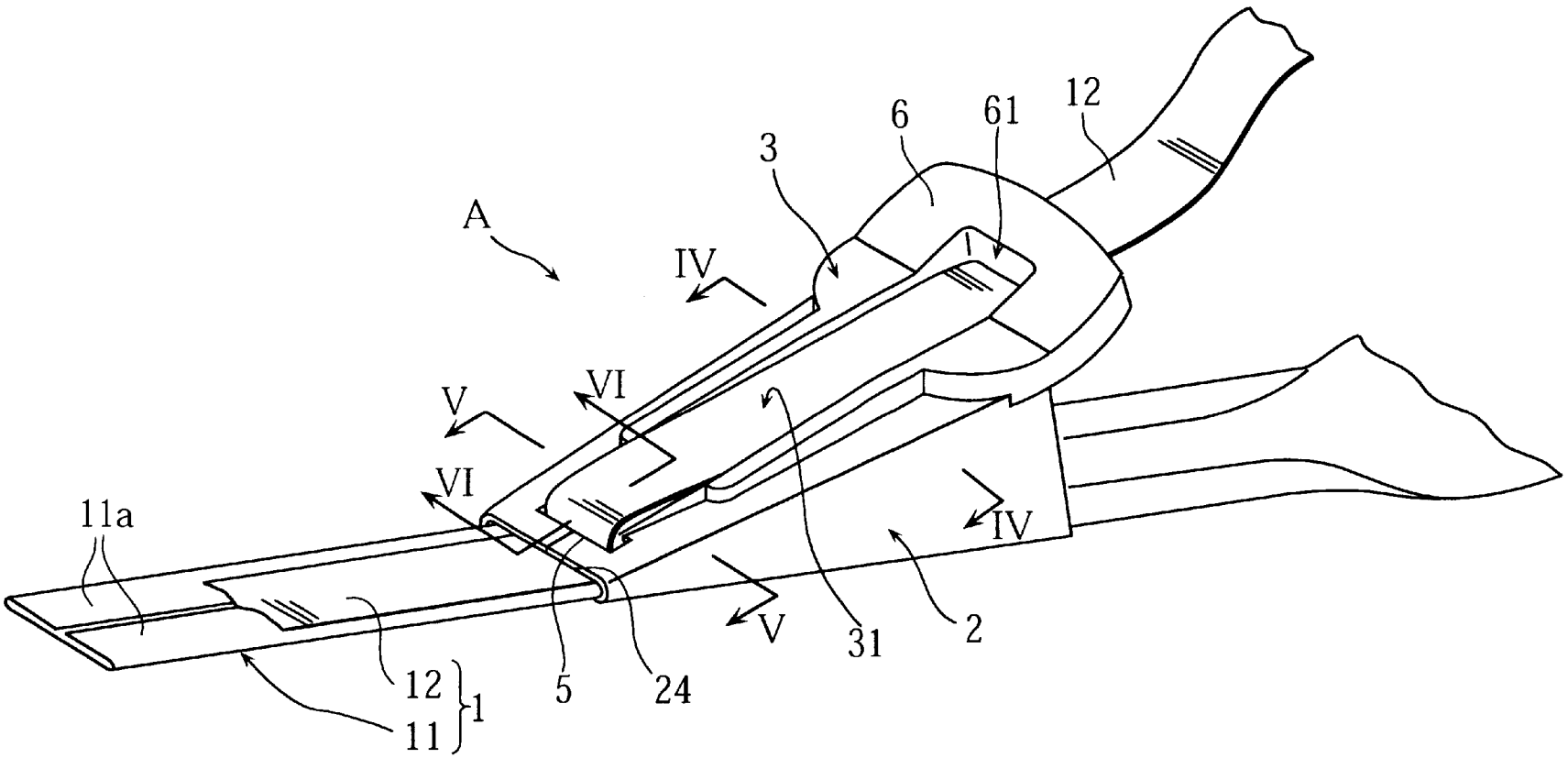
FIG. 1 is a perspective view showing a bias tape maker, together with a bias tape, according to an embodiment of the present invention.
Figure 9:
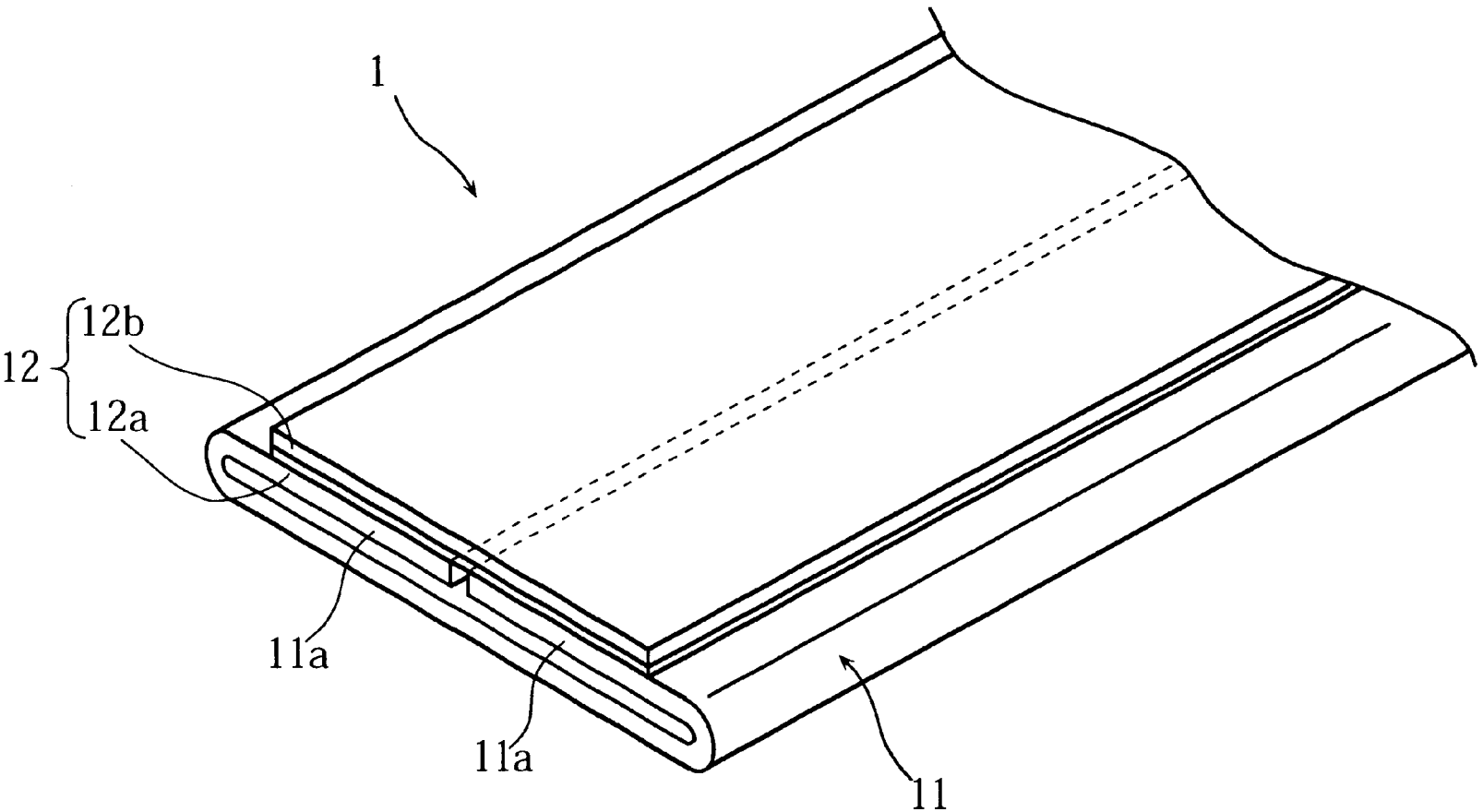
FIG. 9 PRIOR ART
FIG. 9 is a schematic perspective view showing an adhesive bias tape which is made by the bias tape maker of the present invention.
Figure 10:
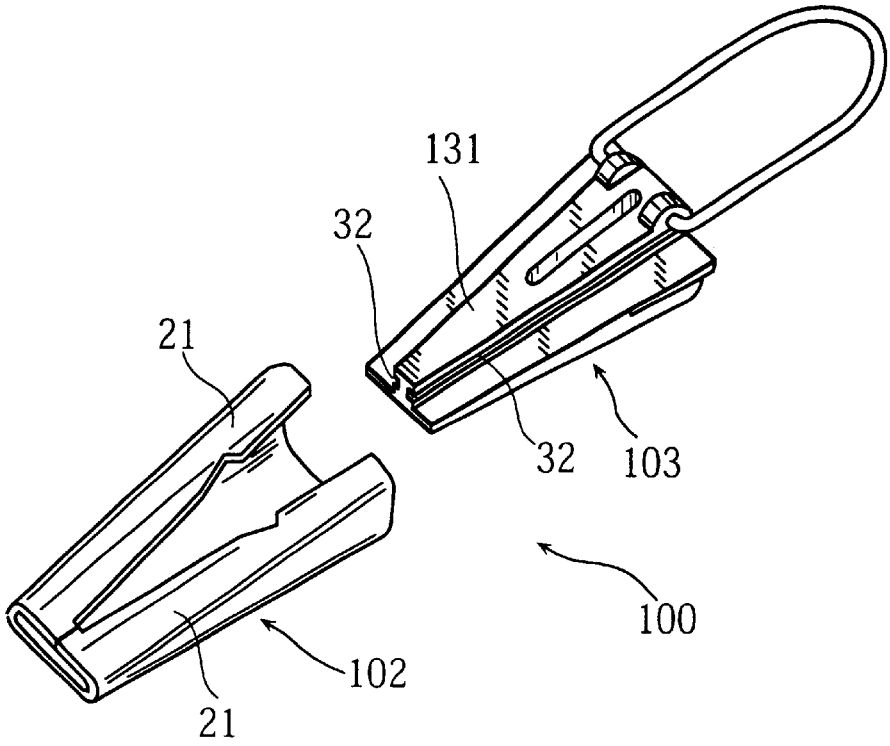
FIG. 10 PRIOR ART
FIG. 10 is an exploded perspective view showing a prior art bias tape maker.
Figure 11:
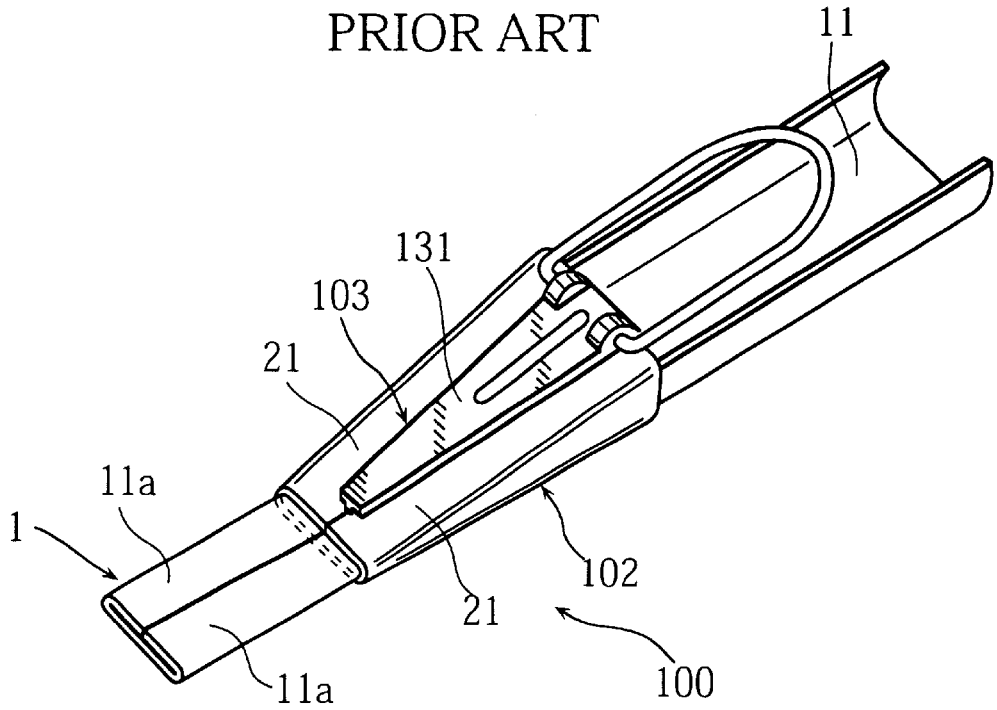
FIG. 11 PRIOR ART
FIG. 11 is a schematic perspective view showing the same prior art bias tape maker.

Referring to FIG. 1, there is illustrated a bias tape maker A for making an adhesive bias tape 1 which includes a main tape 11 of a cloth or fabric and an auxiliary adhesive tape 12 (see also FIG. 9). After biasing with the bias tape maker A, the main tape 11 has a pair of longitudinal edges 11*a* folded toward each other and joined together by the auxiliary tape 12 to form a closed loop which is flattened. The auxiliary tape 12 includes an adhesive layer 12*a* carried on a releasable substrate 12*b* of a silicone paper for example. The adhesive layer 12*a* has such a nature that it becomes tacky only when heated.

The bias tape maker A comprises an outer shell 2, and an inner core 3 for fitting into the outer shell 2. The outer shell 2 may be made by cutting or punching a thin metal plate into a predetermined configuration and bending the plate. The inner core 3 may be molded of a resin.

Figure 2:
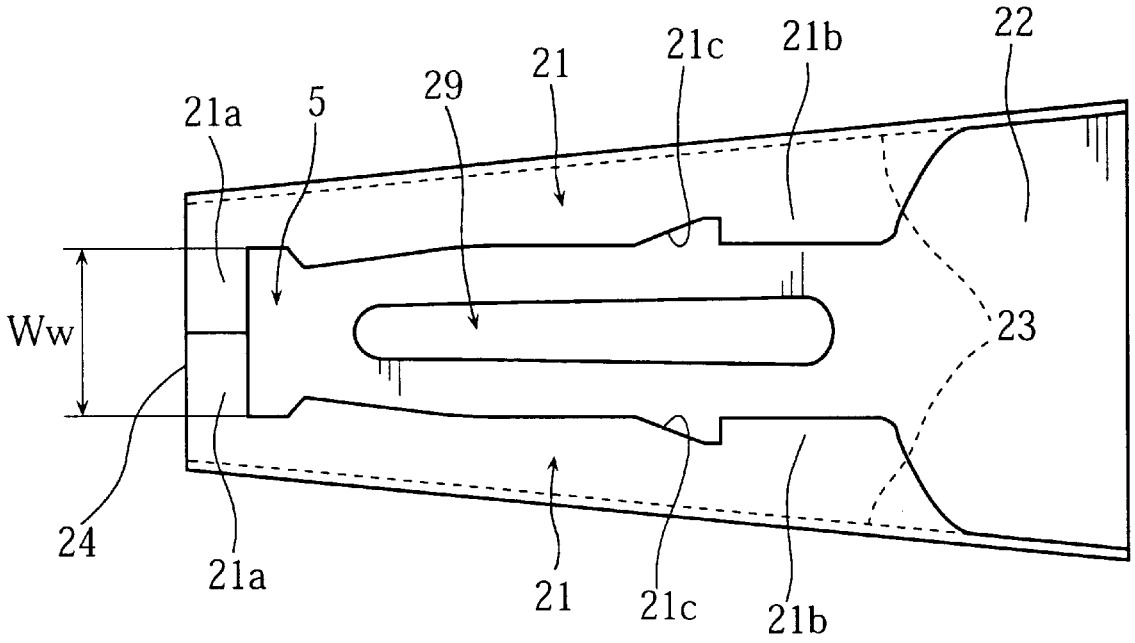
FIG. 2 is a plan view showing an outer shell of the bias tape maker shown in FIG. 1.
Figure 3:
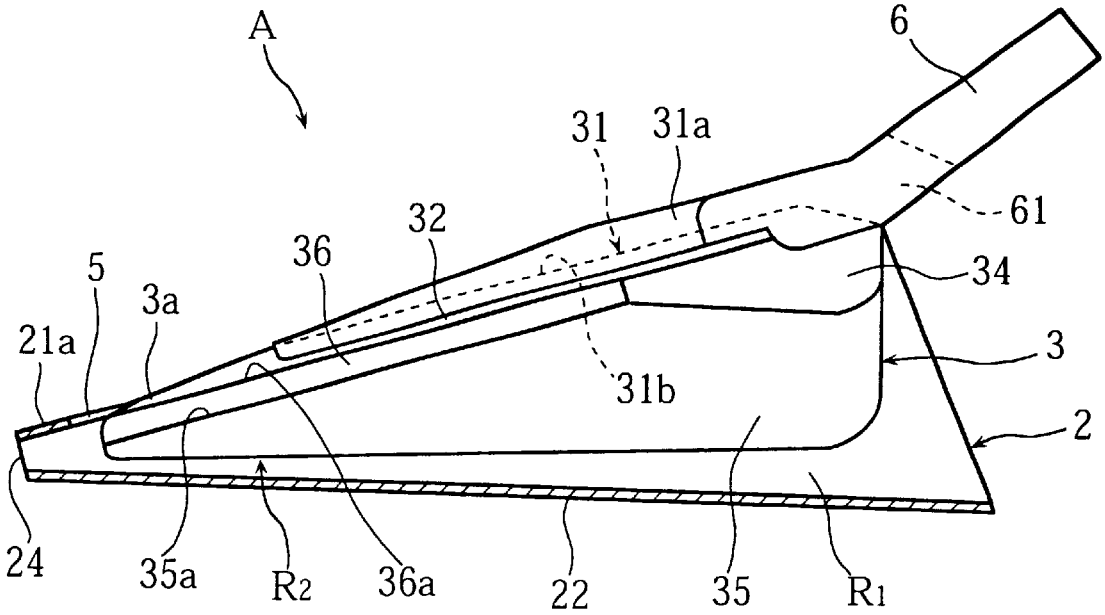
FIG. 3 is a side view, partially in section, showing the inner structure of the bias tape maker shown in FIG. 1.
Figure 8:
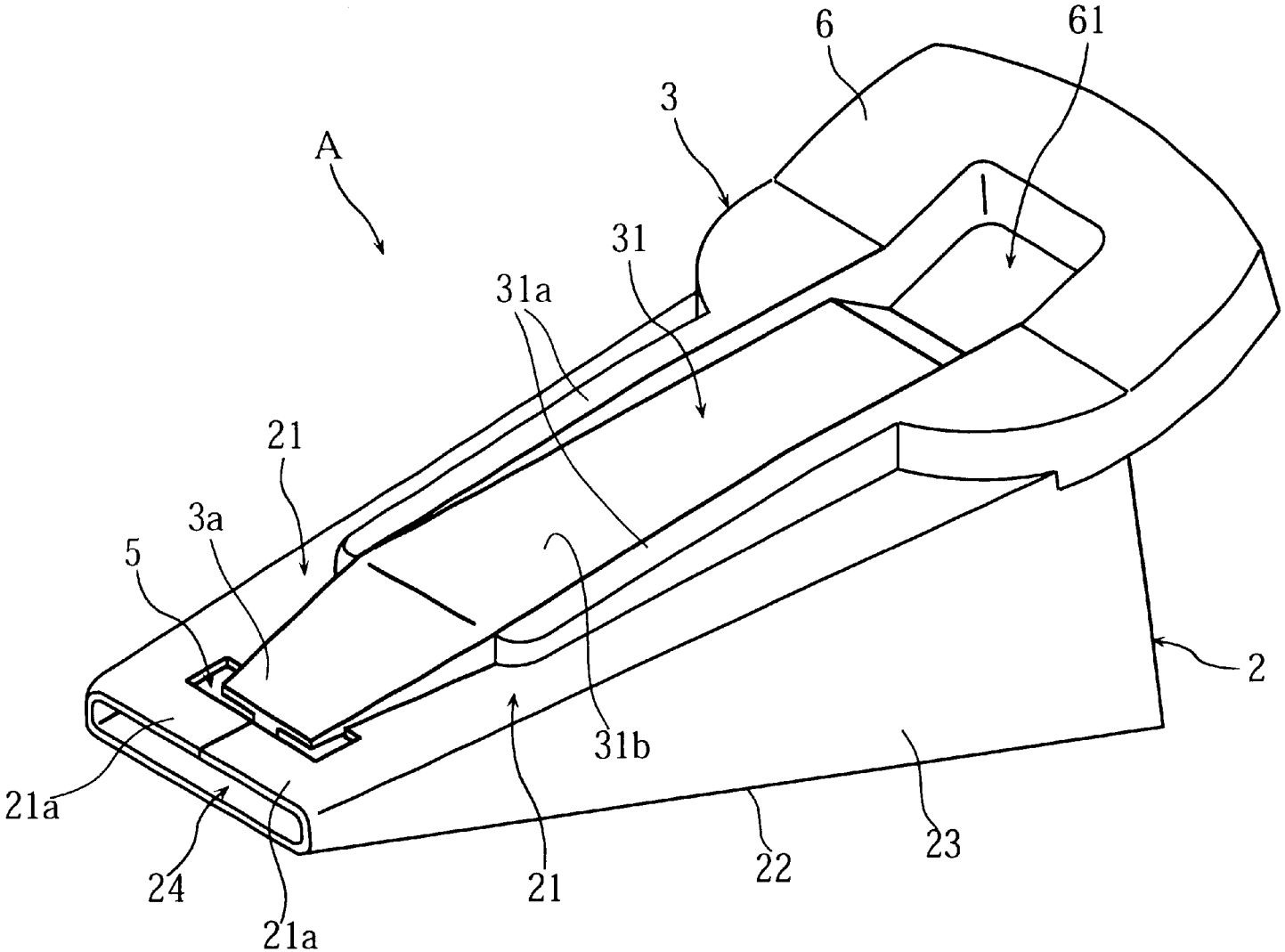
FIG. 8 is a perspective view showing the bias tape maker of FIG. 1 without a bias tape.

As shown in FIGS. 2, 3 and 8, the outer shell 2 includes a bottom wall 22, a pair of sidewalls 23 rising from the bottom wall 22, and a pair of roof margins 21 bent at the respective side walls 23 toward each other. The outer shell 2 tapers from its rear end to its front end.

The roof margins 21 include mutually abutting portions 21*a* near the front end of the outer shell 2 (see particularly FIG. 8). Thus, the outer shell 2 provides a tape exiting port 24 at its front end. Each of the roof margins 21 includes an engaging portion 21*b* for engagement with a corresponding engaging groove 32 of the inner core 3 when the inner core 3 is assembled with the outer shell 2 (see particularly FIGS. 2–4). The engaging portion 21*b* is formed with a generally triangular engaging notch 21*c* for engagement with a corresponding engaging projection (not shown) formed in the engaging groove 32, thereby preventing the inner core 3 from being unexpectedly detached from the outer shell 2.

Each of the roof margins 21 is further formed with a cutout 21*d* (FIG. 2) which defines an auxiliary tape entry window 5 adjacent the tape exiting port 24 together with the counterpart cutout 21*d* of the other roof margin 21. The window 5 has a width $W_w$ which is equal to or slightly larger than the width of the auxiliary tape 12. As shown in FIG. 8, when the outer shell 2 and the inner core 3 are assembled, a front end portion 3*a* of the inner core 3 advances partially into the window 5. However, the window 5 is still kept open for introducing the auxiliary tape 12 into the outer shell 2 adjacent the tape exiting port 24. Alternatively, the window 5 may be defined solely by the outer shell 2 as spaced away from the front end 3*a* of the inner core 3.

As shown in FIG. 2, the bottom wall 22 of the outer shell 2 is formed with a tape advancing slot 29 provided between the front end and the rear end of the outer shell 2. The function of the tape advancing slot 29 will be described later.

Figure 7:
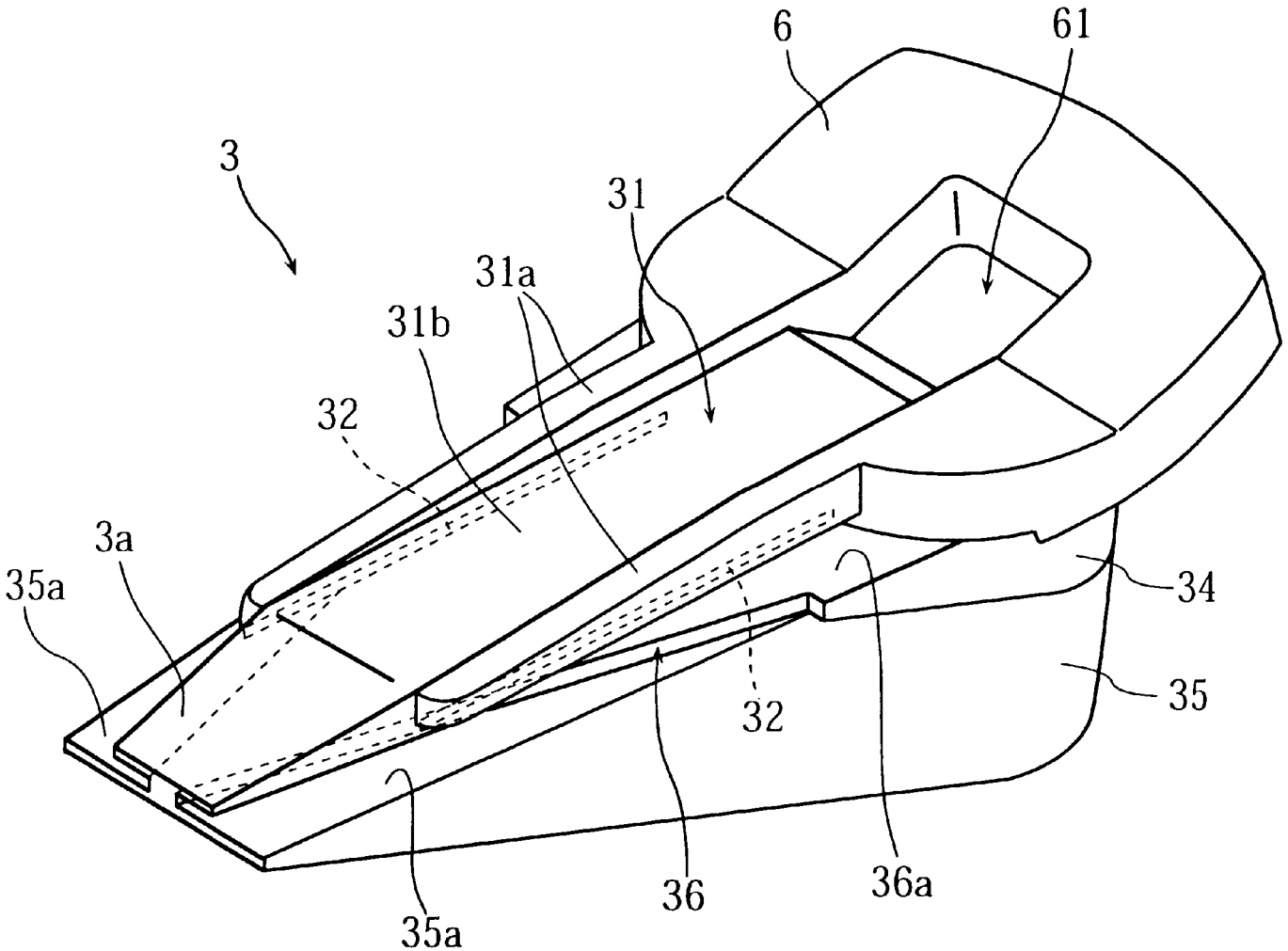
FIG. 7 is a perspective view showing an inner core of the bias tape maker shown in FIG. 1.

As shown in FIGS. 3 and 7, the inner core 3 tapers from its rear end toward its front end. Each of the longitudinal engaging grooves 32 is formed on a respective side surface of the inner core 3 and extends forwardly downward for engagement with the corresponding roof margin 21 of the outer shell 2, as previously described. The inner core 3 mainly comprises two integral portions, i.e., an upper portion located above the engaging grooves 32 and a lower portion located below the engaging grooves 32. When the inner core 3 is assembled with the outer shell 2, the upper portion is exposed, whereas the lower portion is enclosed in the outer shell 2.

Figure 4:
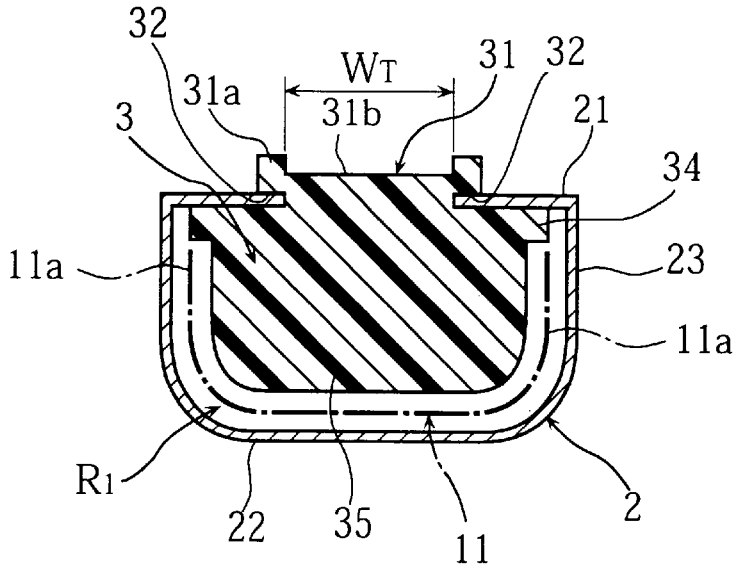
FIG. 4 is a sectional view taken along lines IV—IV in FIG. 1.

As shown in FIG. 1, the inner core 3 is provided, on its top, with an auxiliary tape guide groove 31 extending longitudinally of the bias tape maker A for guiding the auxiliary tape 12 toward the auxiliary tape entry window 5. The guide groove 31 generally corresponds in width to the auxiliary tape 12. As shown in FIG. 4, the guide groove 31 is defined by a bottom surface 31*b* and a pair of side walls 31*a*. The bottom surface 31*b* has a width WT which is equal to or slightly larger than that of the auxiliary tape 12. Each side wall 31*a* has a height which is larger than the thickness of the auxiliary tape 12. Thus, it is possible to smoothly advance the auxiliary tape 12 along the guide groove 31.

As shown in FIGS. 3 and 7, the inner core 3 is formed, at its rear end of the upper portion, with a handle 6 which is inclined backwardly upward. The handle 6 is formed with an auxiliary tape guide hole 61 (FIG. 7) for guiding the auxiliary tape 12. The guide hole 61 has a width which is equal to or slightly larger than that of the auxiliary tape 12 for allowing insertion of the auxiliary tape 12. As shown in FIG. 8, the guide hole 61, the guide groove 31 and the window 5 are aligned longitudinally of the bias tape maker A.

As shown in FIG. 7, the lower portion of the inner core 3 below the engaging grooves 32 comprises a larger width portion 34, a smaller width portion 35, and a generally triangular portion 36. The larger width portions 34 and the triangular portion 36 are continuous with each other and provides a flat upper surface 36*a* on each side of the auxiliary tape guide grove 31. As shown in FIG. 3, each of the engaging grooves 32 is defined between this flat surface 36*a* and the corresponding side wall 31*a* of the guide groove 31. The smaller width portion 35 is located below the larger width portion 34 and the triangular portion 36. The upper surface of the smaller width portion 35 is divided by the triangular portion 36 into two triangular surfaces 35*a*.

Figure 5:
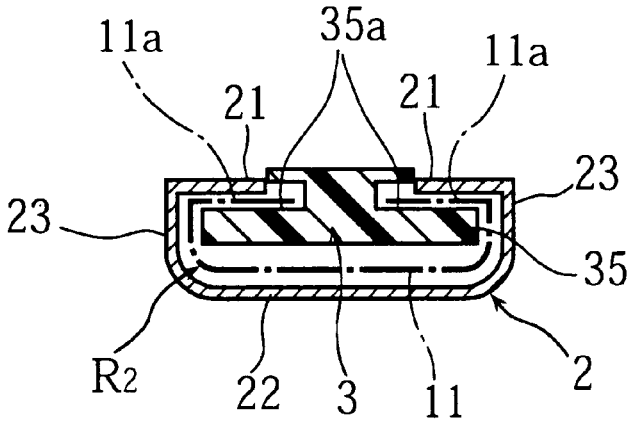
FIG. 5 is a sectional view taken along lines V—V in FIG. 1.

As shown in FIGS. 4 and 5, when the outer shell 2 and the inner core 3 are assembled, a tape inserting portion R1 and a tape folding portion R2 are formed between the outer shell 2 and the inner core 3. The tape inserting portion R1 extends from the rear end of the outer shell 2 for inserting the main tape 11, whereas the tape folding portion R2 extends from the tape inserting portion R1 to the tape exiting port 24 for folding the longitudinal margins 11*a* of the main tape 11 toward each other. Specifically, in passing through the tape inserting portion R1, the main tape 11 is bent to have a U-shaped cross section with the longitudinal margins 11*a* raised. On the other hand, in passing through the tape folding portion R2, the longitudinal margins 11*a* of the main tape 11 are folded toward each other, thereby turning into a pair of folds 11*a*.

For making an adhesive bias tape 1, the above-described bias tape maker A may be used in the following manner.

First, a main tape 11 is introduced into the tape inserting portion R1 from the rear end of the bias tape maker A. Then, the main tape 11 is advanced until the leading end of the main tape 11 is exposed at the tape advancing slot 29. In this state, the user can advance the main tape 11 by making access to the main tape 11 via the tape advancing slot 29 directly with a finger or a short engaging article (not shown). In subsequently passing through the tape folding portion R2, the longitudinal edges 11*a* of the main tape 11 are folded toward each other, as described before.

Finally, the main tape 11 is pulled out from the tape exiting port 24 by the user nipping the leading end of the tape 11 (see FIG. 1).

Figure 6:
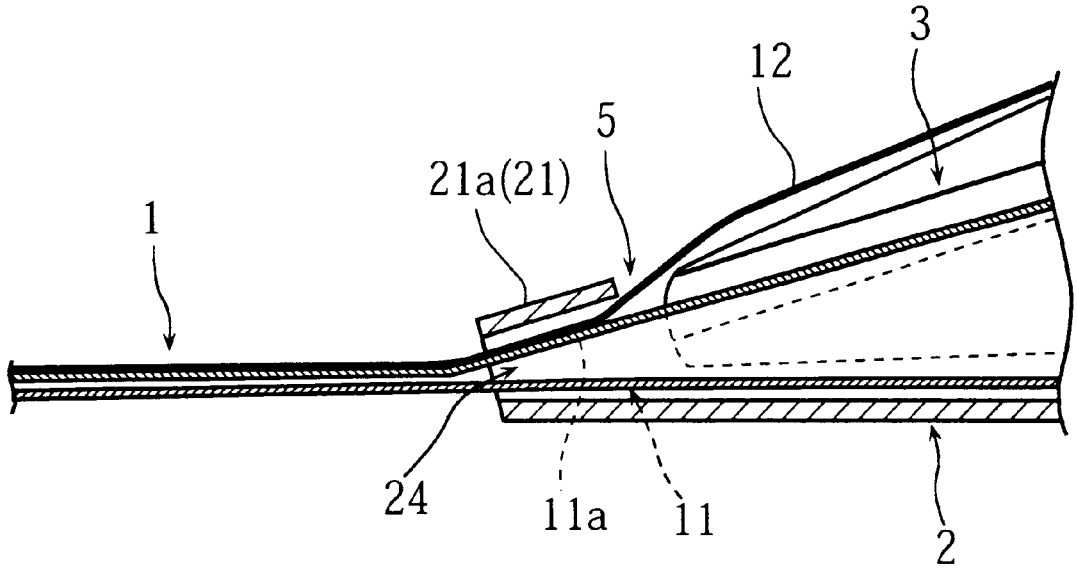
FIG. 6 is a sectional view taken along lines VI—VI in FIG. 1.

Then, as shown in FIG. 1, an auxiliary tape 12 is introduced from the rear side of the handle 6 into the guide hole 61 and is advanced along the guide groove 31. Then, the leading end of the auxiliary tape 12 is inserted through the window 5 into the bias tape maker A. The auxiliary tape 12 is pushed until its leading end projects out from the tape exiting port 24. As shown in FIG. 6, upon passing in front of the inner core 3, the auxiliary tape 12 lies on the folded longitudinal margins 11*a* of the main tape 11.

While pulling out the auxiliary tape 12 together with the main tape 11 from the tape exiting port 24, ironing may be performed from above the auxiliary tape 24. As a result, the folded longitudinal margins 11*a* of the main tape 11 are fixed or set, and at the same time, the auxiliary tape 12 is bonded to the folded longitudinal margins 11*a* of the main tape 11, thus providing an adhesive bias tape 1.

With the bias tape maker A according to the present invention, it is possible to pull out the auxiliary tape 12 together with the main tape 11 from the tape exiting port 24 with the auxiliary tape 12 accurately positioned on the folded main tape 11. Therefore, unlike the prior art bias tape maker, the user need not perform a separate step of accurately positioning the auxiliary tape relative to the main tape. Moreover, the setting of the folds 11*s* and the bonding of the auxiliary tape 12 to the main tape 11 can be performed simultaneously by a single ironing step. Therefore, it is possible to efficiently make an adhesive bias tape 1.

Moreover, since the window 5, the guide groove 31 and the guide hole 61 are aligned longitudinally of the bias tape maker A, the auxiliary tape 12 can be reliably and smoothly introduced into the window 5 and pulled out from the tape exiting port 24 without lateral rubbing. As a result, it is possible to prevent the auxiliary tape 12 from breaking due to friction.

Further, by holding the handle 6 of the inner core 3, the user can press the bottom wall 22 of the outer shell 2 against the workbench, thereby preventing the adhesive bias tape 1 from being unexpectedly lifted from the workbench during ironing. Therefore, the ironing of the adhesive bias tape 1 can be performed efficiently. Since the guide hole 61 is formed at the base end of the handle 6, the user can hold the handle 6 without contacting the auxiliary tape 12, thereby preventing the auxiliary tape 12 from being undesirably deformed. Thus, the user can perform efficient ironing without the need for taking care not to deform the auxiliary tape 12.

The preferred embodiment of the present invention being thus described, it is obvious that the same may be varied in many ways. For instance, the main tape 11 may be made of any material other than cloth or fabric. The bottom of the smaller width portion 35 may be formed with downwardly directed grooves to reduce the contact area between the main tape 11 and the smaller width portion 35 for enabling smooth movement of the main tape 11. Such variations are not regarded as a departure from the spirit and scope of the present invention, and all such variations as would be obvious to those skilled in the art are intended to be included in the scope of the appended claims.

What is claimed is:

1. A bias tape maker comprising:

an outer shell including a tape entering port and a tape exiting port for introduction and exit of a main tape, respectively; and an inner core fitted in the outer shell for defining a main tape passage between the outer shell and the inner core, the main tape passage including a tape folding portion for folding longitudinal margins of the main tape toward each other;

wherein the outer shell is provided with an auxiliary tape entry window means adjacent the tape exiting port for introducing an auxiliary tape into the tape folding portion of the main tape passage.

2. The bias tape maker according to claim 1, wherein the auxiliary tape entry window means has a smaller width than the tape exiting port.

3. The bias tape maker according to claim 1, wherein the outer shell comprises a pair of roof margins which extend toward each other into abutment adjacent the tape exiting port, the auxiliary tape entry window means being defined by a cutout formed in the pair of roof margins adjacent the tape exiting port.

4. The bias tape maker according to claim 3, wherein the inner core includes a lower portion enclosed in the outer shell and an upper portion projecting above the pair of roof margins, the pair of roof margins engaging the inner core at a portion spaced from the tape exiting port, the upper portion of the inner core being formed with an auxiliary tape guide groove for guiding the auxiliary tape toward the auxiliary tape entry window means.

5. The bias tape maker according to claim 4, wherein the auxiliary tape guide groove is aligned with the auxiliary tape entry window means longitudinally of the auxiliary tape.

6. The bias tape maker according to claim 4, wherein the auxiliary tape guide groove has a smaller width than the tape exiting port.

7. The bias tape maker according to claim 4, wherein the upper portion of the inner core has a front end partially extending into the auxiliary tape entry window means.

8. The bias tape maker according to claim 4, wherein the upper portion of the inner core has a rear end formed with a handle which in turn is formed with an auxiliary tape guide hole for introducing the auxiliary tape toward the auxiliary tape guide groove.

9. The bias tape maker according to claim 8, wherein the auxiliary tape guide hole is aligned with the auxiliary tape guide groove and the auxiliary tape entry window means longitudinally of the auxiliary tape.

10. The bias tape maker according to claim 8, wherein the handle is inclined backwardly upward, the auxiliary tape guide hole being provided at a base end of the handle.

11. A combination of a bias tape maker, a main tape and an auxiliary tape, the bias tape maker comprising:

an outer shell including a tape entering port and a tape exiting port for introduction and exit of the main tape, respectively; and an inner core fitted in the outer shell for defining a main tape passage between the outer shell and the inner core, the main tape passage including a tape folding portion for folding longitudinal margins of the main tape toward each other;

wherein the inner core includes an upper portion formed with an auxiliary tape guide groove for guiding the auxiliary tape toward the tape exiting port.

12. The combination according to claim 11, wherein the auxiliary tape guide groove has a width generally equal to that of the auxiliary tape.

13. The combination according to claim 11, wherein the upper portion of the inner core has a rear end formed with a handle which in turn is formed with an auxiliary tape guide hole for introducing the auxiliary tape toward the auxiliary tape guide groove.

14. The combination according to claim 13, wherein the auxiliary tape guide hole is aligned with the auxiliary tape guide groove longitudinally of the auxiliary tape.

15. The combination according to claim 13, wherein the handle is inclined backwardly upward, the auxiliary tape guide hole being provided at a base end of the handle.

* * * * *